United States Patent [19]

Turek et al.

[11] 4,071,131

[45] Jan. 31, 1978

[54] ELECTRONIC CONTROL SYSTEM

[75] Inventors: Clarence W. Turek; Aaron B. Aronson, both of Glenview; Dale C. Wittlock, Morton Grove, all of Ill.

[73] Assignee: Signode Corporation, Glenview, Ill.

[21] Appl. No.: 631,690

[22] Filed: Nov. 13, 1975

[51] Int. Cl.[2] ..... B41J 7/96

[52] U.S. Cl. ..... 197/6.4; 101/93.02; 101/93.19; 197/55

[58] Field of Search ..... 101/93.02, 93.19; 197/55, 6.4–6.7, 193, 107

[56] References Cited

U.S. PATENT DOCUMENTS

| | | | |
|---|---|---|---|
| 2,869,703 | 1/1959 | Hebel | 197/13 |
| 3,399,753 | 9/1968 | Ravelle | 101/93.19 |
| 3,651,916 | 3/1972 | Becchi | 101/93.19 |
| 3,712,212 | 1/1973 | Berry | 101/93.19 |
| 3,785,470 | 1/1974 | Schacht | 197/6.4 |
| 3,837,457 | 9/1974 | Anglin et al. | 197/55 |
| 3,861,512 | 1/1975 | Coriasco et al. | 197/55 |

OTHER PUBLICATIONS

Kerr, Serial Printer with Error Indicator, IBM Technical Disclosure Bulletin, vol. 9, No. 2, p. 130, 7/66.

Emig Space-to-Print and Print-to-Space Interlock IBM Technical Disclosure Bulletin, vol. 12, No. 3, p. 471, 8/69.

*Primary Examiner*—Clifford D. Crowder
*Assistant Examiner*—William Pieprz
*Attorney, Agent, or Firm*—Dressler, Goldsmith, Clement, Gordon & Shore, Ltd.

[57] ABSTRACT

An electronic control system for a marking machine having a moving marking member carrying a plurality of marking symbols in which the marking member is stopped and displaced to mark a workpiece with a selected one of the symbols at a marking location, the control system including means for generating pulses in synchronism with movement of the symbols past the marking location, a register responsive to the pulses for producing outputs ccrresponding to the symbols, means to select one of the outputs corresponding to a selected symbol, and means responsive to the selected output for effecting stopping and displacement of the marking member to mark the workpiece. The control system is operable to insure marking with a selected symbol and to preclude inadvertent opertion of the marking machine until the control system is reset after each marking cycle.

19 Claims, 13 Drawing Figures

25
21
20
83
82
81
84
46
80
21
74
4.
4.
24
22
70

138a
138b
138c
138d
138e
A B C D E F G H
I J K L M N O P
Q R S T U V W X
Y Z £ 1 2 3 4 5
6 7 8 9 0 . -
168
162
164
40
173
173a
72-40
72-33
164-32
164-25
72-24
164-15
72-16
164-8
72-9
164-7
72-7
72-1
164-1
164-2
137
136
172
171
170
142
144
180a
196
148a
124
174
146a
179
180
211
212
214
213
210
122
152
185
184
183
182
181
126
148
178
175
158
159
146
177
To 112
To 116
To 114

ELECTRONIC CONTROL SYSTEM

BACKGROUND OF THE INVENTION

This invention relates to control systems and in particular to control systems for apparatus of the type used for imprinting or marking nameplates and other similar workpieces. The control system of the present invention has particular application for use with electrically operated marking machines utilizing a keyboard and a marking member which may be displaced to imprint or mark characters or symbols carried by the marking member on metal or plastic nameplates or other similar workpieces.

Marking machines of this general type include a surface to hold and position a workpiece to be imprinted. Imprinting or marking is usually effected by a means such as an interchangeable marking member provided with desired characters or symbols.

Typically, the marking member has been indexed and actuated by use of a typewriter-like keyboard and electromechanical devices associated therewith. In operation, a character or symbol is selected by actuating or depressing one of the keyboard keys corresponding to the character or symbol to be marked. The marking member may be indexed to locate the selected character or symbol in a marking position and is subsequently displaced into engagement with the workpiece to execute a marking stroke. The workpiece may then be advanced a selected distance to position another portion of the workpiece in the marking position for the next marking stroke.

In co-pending application Ser. No. 488,026, filed July 12, 1974, assigned to the assignee of this application, now U.S. Pat. No. 3,945,479, issued Mar. 23, 1976, incorporated herein by reference, there is disclosed such a marking machine designed for imprinting at relatively high speeds. As disclosed in the above-mentioned patent, the marking machine includes a frame and a marking ram carrying a marking member or dial which is slidably mounted on the frame and driven by an electric motor. The marking dial is rotated and may be transversely displaced to effect the desired marking of the workpiece.

Although the marking machine disclosed in the aforementioned patent results in improved reliability and performance as compared with the prior art, and operational control of the machine is governed by use of electromechanical devices, e.g., switches, which limit speed of operation and which are subject to the usual wear and maintenance problem associated with these types of components.

In order to increase and improve the reliability and operational speed of such marking systems, it is desirable to minimize or eliminate the difficulties associated with such components.

SUMMARY OF THE INVENTION

In accordance with the present invention, there is provided a control system for use with marking machines such as the type disclosed in the aforementioned U.S. patent No. which will result in improved reliability, which minimizes electromechanical wear and resulting service requirements, and which at the same time can provide high speed and reliable control functions to maximize operation of the marking machine.

A control system incorporating the present invention produces a plurality of pulses in synchronism with the movement of symbols or characters on the marking member past a marking location. A plurality of outputs corresponding to the characters are produced in response to the pulses and one of the outputs is selected in response to actuation of a keyboard key. The control system is responsive to the selected outputs to operate the machine to stop the marking member with the selected character or symbol in the marking position if the dial is to be stopped, and displacing the marking member into engagement with a workpiece to effect marking of the workpiece with the selected symbol.

At the same time, the control system sustains the selected output until completion of the marking cycle, precludes inadvertant marking of the workpiece, and improves the response time of the machine to actuation of the keys to increase the operating speed of the machine without adverse effects on accuracy and reliability.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DESCRIPTION OF THE PREFERRED EMBODIMENT

Figure 1:
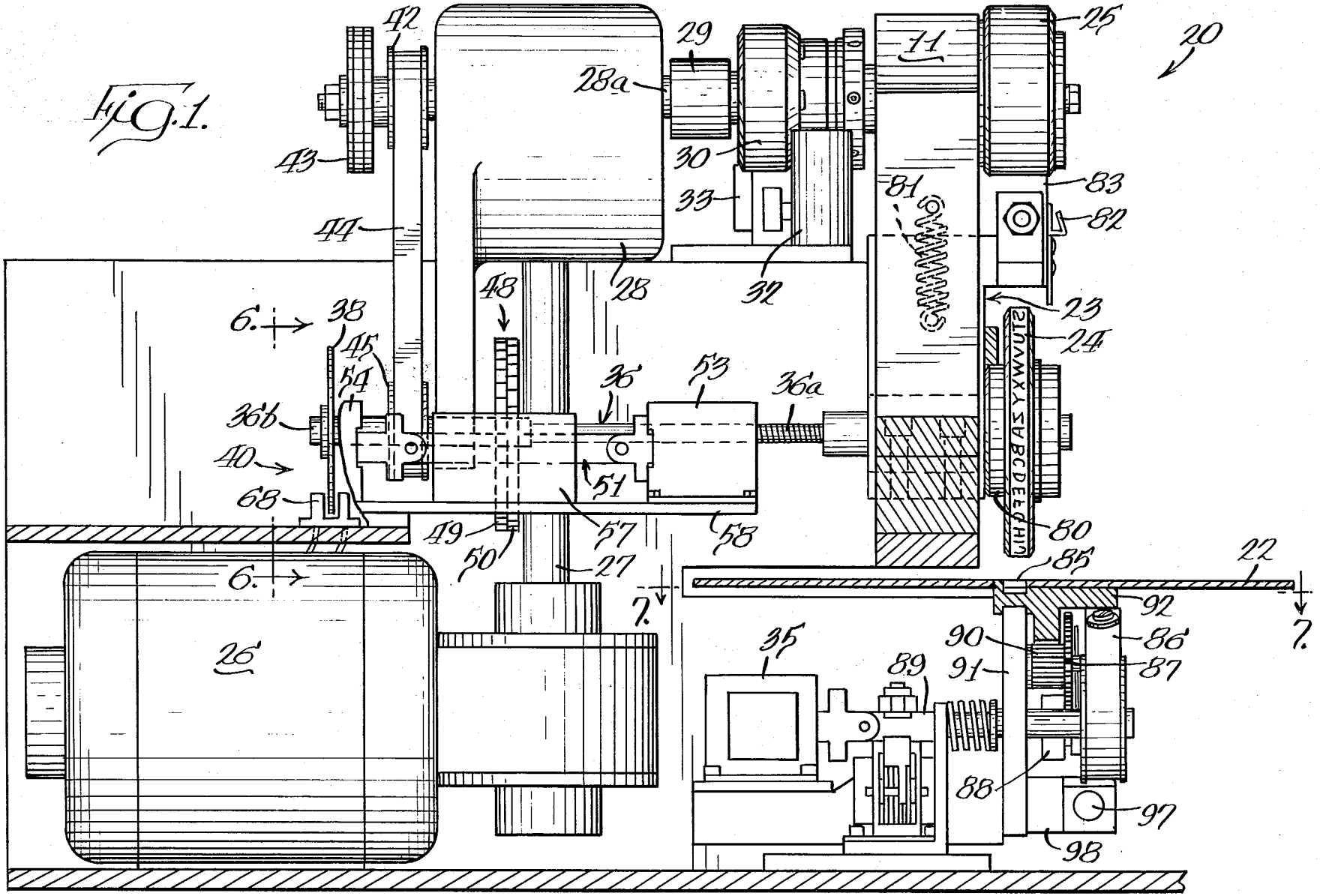
FIG. 1 is a fragmentary side elevational view, partly in section, of a marking machine in which a control system embodying the present invention is used and taken along plane 1—1 in FIG. 2, the outer housing having been removed to show details of the construction.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated. The scope of the invention will be pointed out in the appended claims.

A control system incorporating the present invention is utilized for controlling operation of apparatus such as the marking machine 20 shown in the drawing. Such a marking machine includes a frame 21, an indexing table 22 slidably mounted in frame 21, and a marking ram 23 mounted in frame 21 above indexing table 22 and carrying a marking member, shown as a marking dial 24.

The actual marking or imprinting of a workpiece supported on the indexing table 22 takes place on a downward stroke of the marking ram 23 which displaces the marking dial 24 causing it to contact the workpiece. The marking ram 23 is actuated by a cam 25 journaled in frame 21 which is driven by an electric motor 26. The drive train for marking ram 23 includes an interconnecting shaft 27 which is connected at right angles with the motor output shaft and provides power input into transmission 28. The transmission output shaft **28*a* is connected by means of a coupling 29 through a single-revolution clutch 30 to eccentric cam 25**.

The clutch 30 is provided with a peripheral stop pin 31 (FIG. 2) which abuts a cam block 32 pivotally mounted on frame 21. The cam block 32 is actuatable to release stop pin 31 by means of a clutch solenoid 33. A limit switch 34 responsive to the transverse displacement of the marking ram 23 is operably connected to energize a spacing solenoid 35 at a point in time when the ram 23 is moving upwardly.

The details of the marking ram 23 are described in the aforementioned U.S. Pat. No. 3,945,479, incorporated herein by reference. The rotatable marking dial 24 is carried by marking ram 23 and is mounted thereon by means of an indexing shaft 36 in a manner which will be described in detail hereinbelow.

The indexing assembly for marking dial 24 is also driven by electric motor 26 and includes the indexing shaft 36 which carries marking dial 24 and an apertured disc 38 forming a part of an optical shaft position pulse generator 40, described below. The disc 38 is suitably affixed to indexing shaft 36. For actuating the indexing assembly, the transmission output shaft **28*a* is provided with a pulley 42 which is driven through slip clutch 43 mounted on terminal portion of the transmission output shaft. A transmission belt 44 on pulley 42 drives another pulley 45 mounted on indexing shaft 36 which, in turn, drives marking dial 24**.

The indexing shaft 36 comprises two interconnected portions, flexible portion **36*a* and rigid portion 36*b*. The marking dial 24 is mounted at the distal end of flexible portion 36*a* and is journaled in a slide block 46 forming part of the marking ram 23 by means of a suitable bearing. The relatively easy accessibility to marking dial 24** permits easy interchangeability thereof, when desired.

A double ratchet gear 48 is fixedly mounted on rigid portion **36*b* of indexing shaft 36 and rotates therewith. The distal end of rigid portion 36*b* carries the apertured disc 38**.

Figure 2:
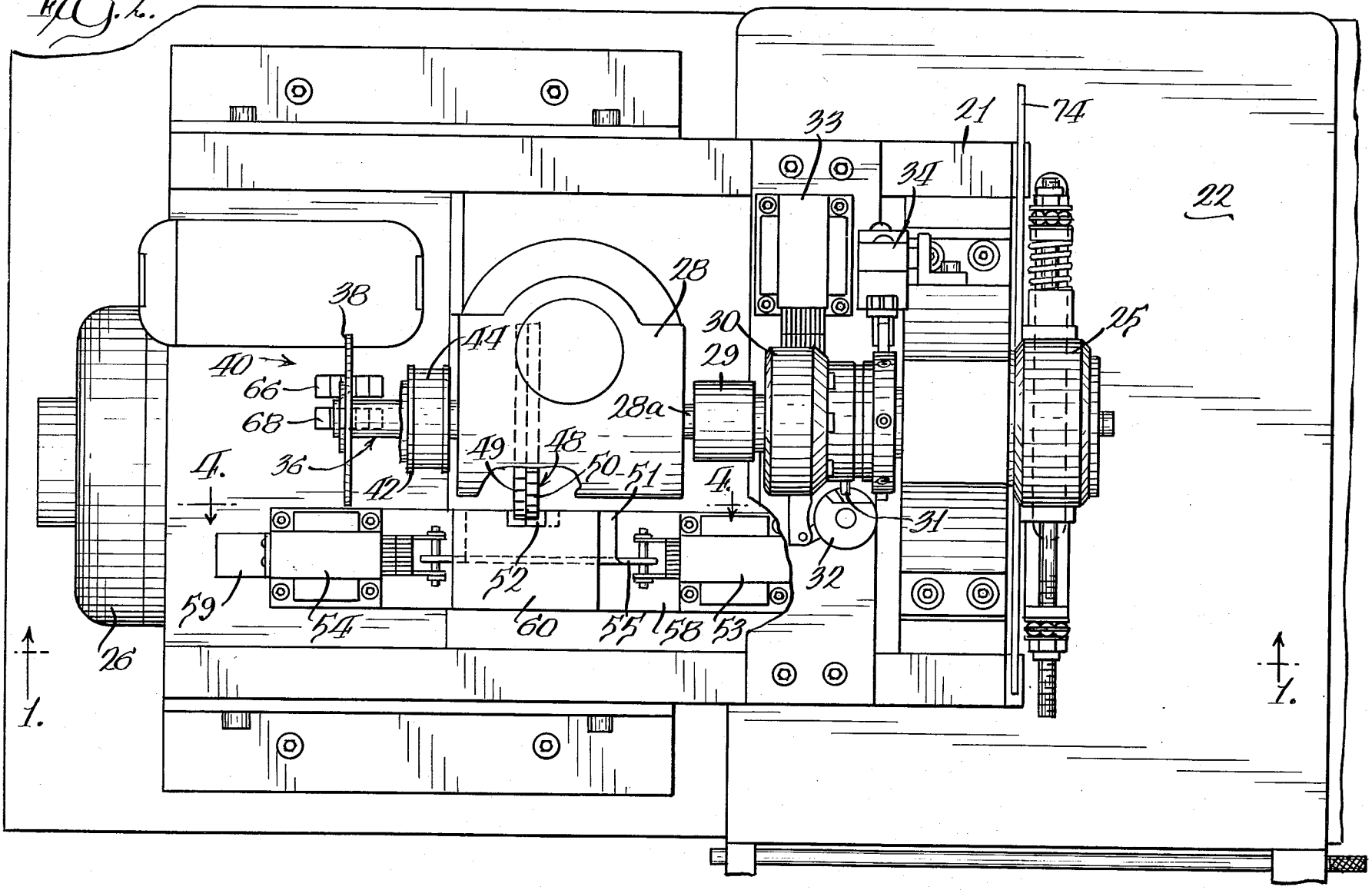
FIG. 2 is a plan view of the marking machine shown in FIG. 1.
Figure 5:
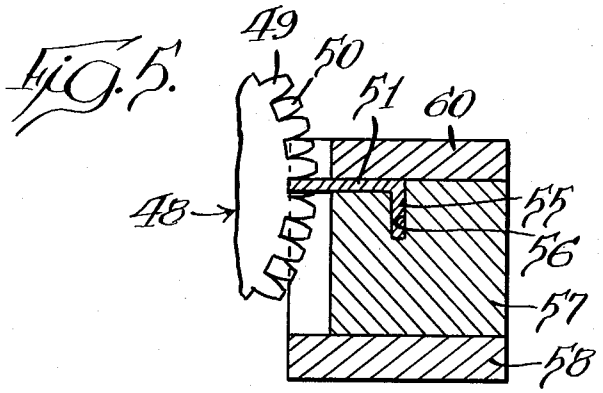
FIG. 5 is a sectional elevation taken along plane 5—5 in FIG. 4.

Double ratchet gear 48 is provided with a pair of substantially parallel rows of equally-spaced gear teeth 49, 50, respectively, which determine the possible indexing positions for dial 24. As shown in FIGS. 1, 2 and 5, the gear teeth in rows 49 and 50 are disposed relative to each other so that one row of gear teeth is out of phase relative to the other row of gear teeth by about one-half the distance between consecutive gear teeth in each row. A single detent plate 51 is positioned for engagement with double ratchet gear 48 and receives teeth rows 49 and 50 in notch 52 when in a neutral position. In a working position, as shown in FIG. 2, detent plate 51 is illustrated as engaging gear tooth row 50.

For indexing marking dial 24, detent plate 51 is moved into engagement with double ratchet gear 48 by means of a pair of detent solenoids, an "A" detent solenoid 53 and a "B" detent solenoid 54, which are connected to opposite ends of detent plate 51. In the disclosed embodiment, detent plate 51 is provided with a longitudinal flange 55 which is received in a longitudinally-extending notch 56 in a detent plate support block 57 (FIG. 5). The support block 57 is, in turn, mounted on detent base plate 58 which is secured to frame 21 in any convenient manner.

Figure 4:
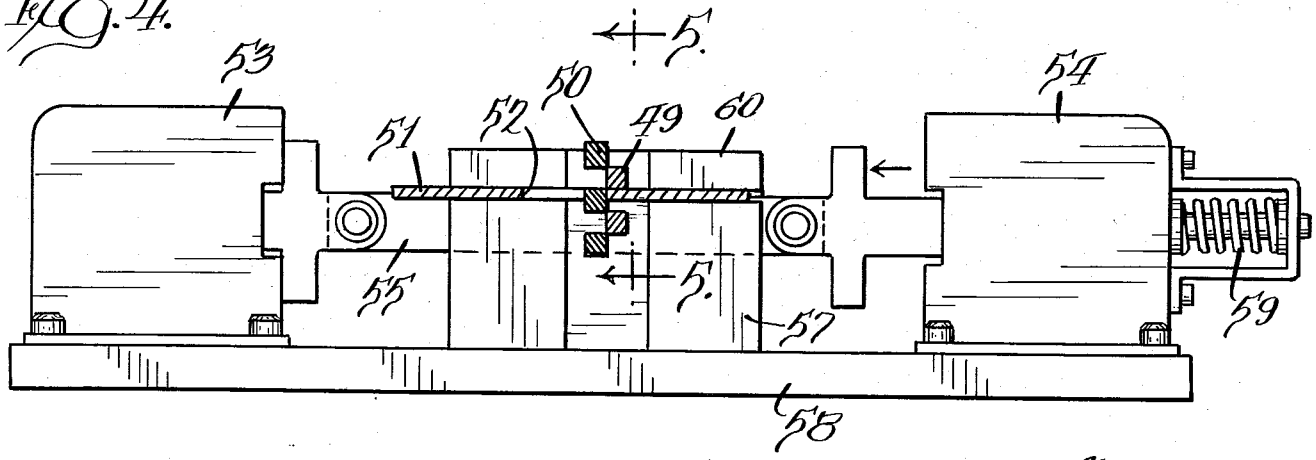
FIG. 4 is an enlarged elevational view, partly in section, taken along plane 4—4 in FIG. 2.

A return spring 59 serves to position notch 52 in detent plate 51 so as to receive ratchet gear 48 therein. Thus, when one of detent solenoids 53 or 54 is energized, detent plate 51 is shifted laterally to engage a gear tooth either in row 49 or in row 50, as can be readily seen from FIG. 4. A detent cover plate 60 may be secured to support block 57 and is substantially coextensive with detent plate 51.

Energization of clutch solenoid 33 and detent solenoids 53, 54 is governed by an electronic control system, described in more detail below, in part in response to a plurality of pulses generated by the optical shaft position pulse generator 40 shown in FIGS. 1, 2 and 6. The pulse generator 40 includes the digitally encoded apertured disc 38 affixed to the free end of rigid portion **36*b* of indexing shaft 36. The apertured disc 38 is digitally encoded with a plurality of apertures 62 spaced evenly around the periphery of the disc 38. In the disclosed embodiment, the number of apertures 62 corresponds to the number of characters or symbols on the periphery of the marking dial 24. The coded disc 38 includes an additional, reset or clear aperture 64 disposed radially inwardly of the coded apertures 62**.

A pair of slotted optical limit switches 66, 68 are supported on the frame 21 with the disc 38 passing through the gaps or slots 69 forming part of the optical limit switch unit. A suitable limit switch is a Monsanto model MCA8 which is a device which channels light from a GaAs infrared light emitting diode onto a silicon phototransistor. These semiconductor chips face each other across the air gaps 69 through which the apertured disc 38 passes.

Each of the limit switches 66, 68 senses an object in the air gap 69 by its effect on light transmission. Thus, as the disc 38 rotates through the air gaps 69 of the optical limit switches 66, 68, a series of pulses are generated, one as each aperture passes through the gap or slot 69.

Figure 6:
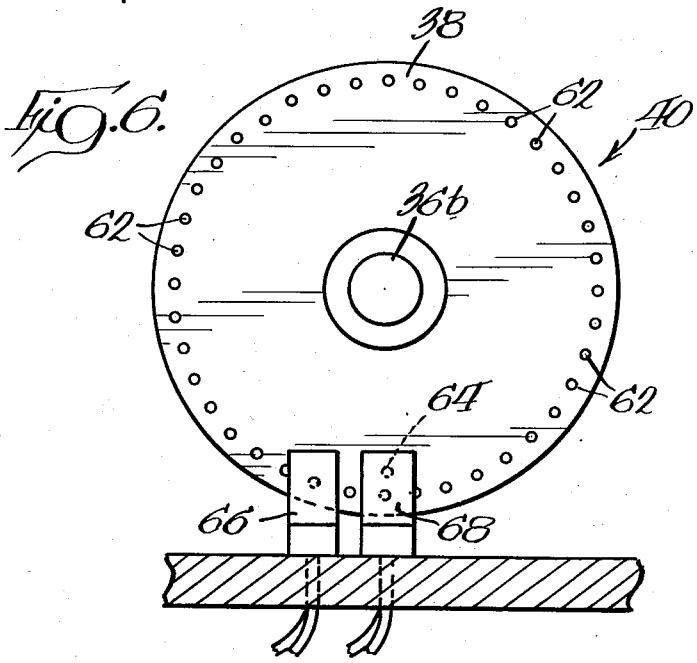
FIG. 6 is an enlarged elevational view taken along plane 6—6 in FIG. 1.

As shown in FIG. 6, the two optical limit switches 66, 68 are disposed side by side and positioned so that limit switch 66 is responsive to the coded apertures 62 and the limit switch 68 is responsive to the reset aperture 64. Thus, as the coded disc 38 rotates with indexing shaft 36, a plurality of pulses are generated by limit switch 66, and an additional reset or clear pulse is generated by limit switch 68 once each revolution of the disc 38.

Figure 3:
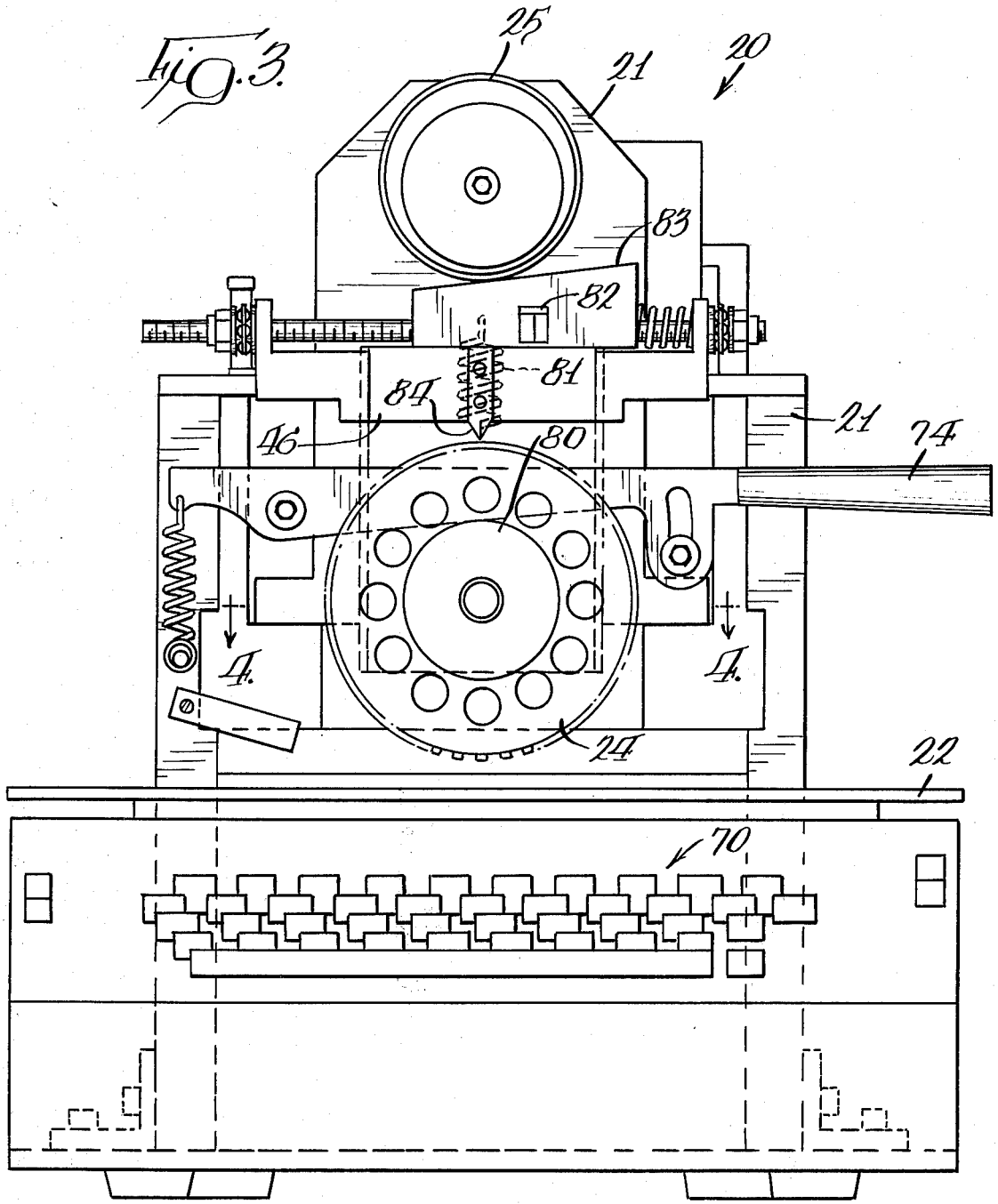
FIG. 3 is an end elevational view of the marking machine shown in FIG. 1.

The energization of detent solenoids 53, 54, and subsequent energization of clutch solenoid 33 is initiated by actuation of the individual keys of an alphanumeric keyboard 70 (FIG. 3). Each of the individual keys of keyboard 70 operate a different one of a plurality of switches 72-1 through 72-40 (FIG. 11) forming a part of the control system. Preferably, keys for alternate symbols or characters on the marking dial effect operation of the same detent solenoid. Thus, when a key on keyboard 70 is actuated, the corresponding switch 72 closes to complete a circuit in the control system, as described below, and energizes one of the detent solenoids 53, 54. The energized detent solenoid pulls detent plate 51 into double ratchet gear means 48 from one side or the other, thereby stopping gear 48 in a position which locates the selected character on marking dial 24 in a marking position immediately above a workpiece, e.g., a nameplate, to be marked.

A manually operable pushdown lever 74 connected to the marking ram 23 may be used to aid in the initial positioning of a workpiece for marking. When the pushdown lever 74 is moved downwardly so as to engage a hub 80 provided on the rearward face of marking dial 24, further downward movement of lever 74 causes slide block 46 to move downwardly until such time as marking dial 24 abuts against a workpiece positioned therebelow. In this manner the actual point of contact between marking dial 24 and a workpiece can be readily ascertained before actual marking is commenced. Upon release of lever 74, slide block 46 returns to its rest position by the action of slide block return springs 81.

A pointer 82 on wedge block 83 serves to indicate the depth of the marking ram stroke and can be appropriately calibrated. A dial alignment indicator 84 can also be provided to facilitate the alignment of marking dial 24 during installation or when dials are interchanged to provide different sizes or styles of marking characters.

A workpiece, e.g., a nameplate, to be marked is positioned on indexing table 22 over an anvil 85 and is suitably clamped or otherwise positioned thereon so that the nameplate advances when indexing table 22 is advanced by the pulling action of a negator spring 86 associated therewith. The mechanism for advancing indexing table 22 comprises negator spring 86, escapement wheel 87, and escapement cam 88 (FIG. 7) which detains escapement wheel 87 against the pull of negator spring 86.

Figure 7:
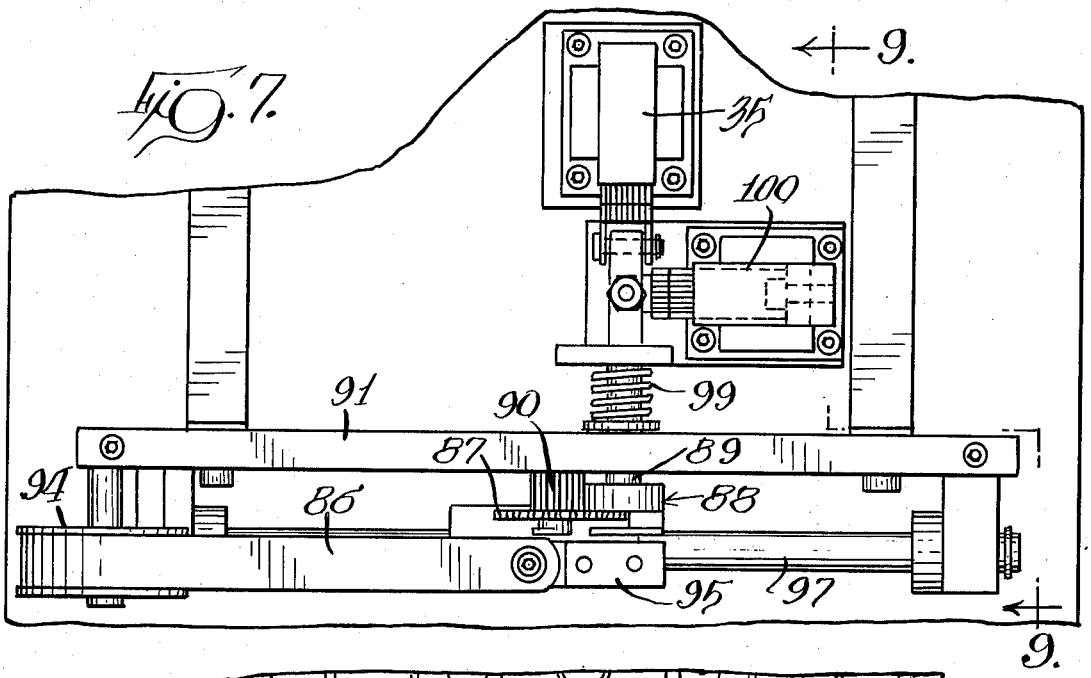
FIG. 7 is a fragmentary plan view taken along plane 7—7 in FIG. 1 with the indexing table removed.

Cam 88 is mounted on one end of an elongated escapement cam shaft 89 in engagement with escapement wheel 87 which is provided with an integral pinion 90. Escapement cam shaft 89 is slidably and rotatably mounted in frame 21. A slide support 91 mounted on frame 21 carries an anvil slide 92, provided on the underside thereof with a rack 93 which engages pinion 90. The free end of negator spring 86, wound on drum 94 is connected to a carriage 95 (FIG. 7). An anvil slide pin 96 on carriage 95 engages anvil slide 92 (FIGS. 7, 8) thereby subjecting anvil slide 92 to the pull of negator spring 86 which provides a substantially constant pull against the aforesaid escapement mechanism.

Carriage 95 partially supports indexing table 22 and is slidably mounted on carriage shaft 97 (FIGS. 7, 8) which, in turn, is mounted on and traverses across the forward end of frame 21 parallel to the usual movement of indexing table 22. Carriage stops 98 at either end of shaft 97 limit the travel of carriage 95 and thus the movement of anvil slide 92 and indexing table 22.

Figure 8:
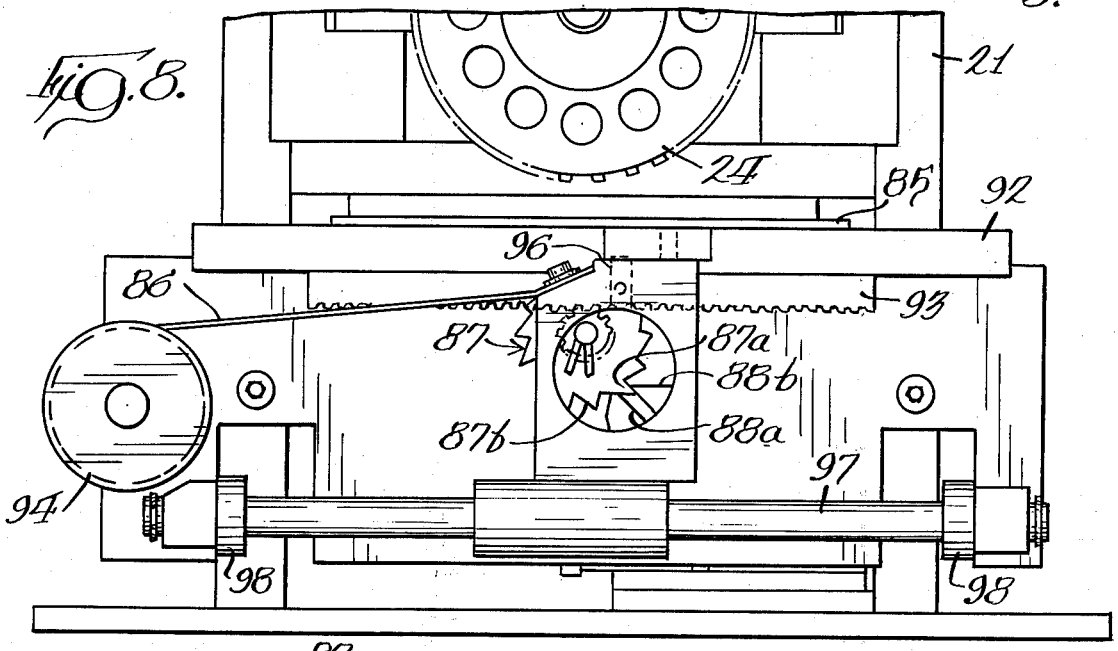
FIG. 8 is a fragmentary end elevational view similar to FIG. 3 with the keyboard removed to show interior detail.
Figure 9:
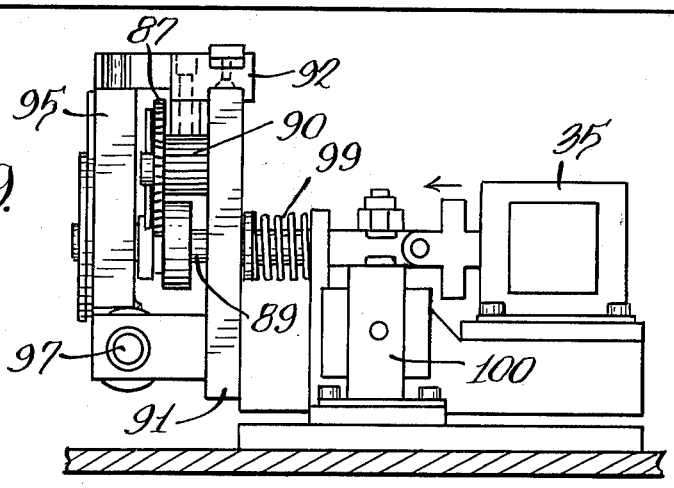
FIG. 9 is an elevational view taken along plane 9—9 in FIG. 7.

To permit incremental advance of indexing table 22, the escapement cam 88 is provided with a pair of spaced, parallel detent faces **88*a* and 88*b* which are positioned to consecutively engage a tooth on escapement wheel 87 as shown in FIG. 8 where tooth 87*a* engages detent face 88*b*. The spacer solenoid 35 is suitably linked to escapement cam shaft 89 and thus to cam 88, and is spring biased in the forward direction when deenergized so that an axial forward movement of shaft 89 by the action of an escapement cam spring 99 shifts detent face 88*b* out of engagement with tooth 87*a* and permits tooth 87*b* to engage detent face 88*a*. Subsequent retraction of shaft 89 when solenoid 35 is energized withdraws detent face 88*a* from engagement with tooth 87*b* and permits tooth 87*b* to abut against detent face 88*b*. In this manner, the energization and subsequent deenergization of spacing solenoid 35 permits indexing table 22 to advance one space, in response to urging by negator spring 86, after a character has been imprinted on a nameplate or similar workpiece carried thereon or when a spacer key has been depressed and released on keyboard 70**.

Release of indexing table 12 to permit bidirectional movement for positioning a nameplate under marking dial 24 is effected by a release solenoid 100 which is connected to escapement can shaft 98 to pivot cam 88 counterclockwise and detent faces **88*a*, *88b* clear of escapement wheel 87, thereby permitting uninterrupted travel of carriage 95 from one extreme position to the other while the release solenoid 100 remains energized. Sufficient play is provided in the connection between spacing solenoid 35 and shaft 89 so that no excessive stresses are placed on the connection when shaft 89 is pivoted by release solenoid 100**.

If desired, indexing table 22 can be provided with a suitable workpiece locator gauge, as described in said U.S. Pat. No. 3,945,479.

In operation, when the marker machine is turned on, the motor 26 is energized, and output shaft **28*a* of transmission 28 turns continuously. Indexing shaft 36 is driven by transmission belt 44 which drives the pulley 45 keyed to indexing shaft 36. Because of the action of slip clutch 43, the rotation of double ratchet gear 48 and coded disc 38 can be stopped without interferring with the rotation of the output shaft 28*a***.

The forward end of rotating output shaft **28*a* drives single revolution clutch 30 through coupling 29. The cam 25 is actuated for one revolution at a time by the clutch 30, and rotation of cam 25 causes slide block 46 to move substantially vertically down and up through a predetermined stroke, usually about 3/16 inch, so as to bring marking dial 24** into contact with a workpiece to be marked.

Marking dial 24 is rotated by indexing shaft 36 through flexible portion **36*a* thereof which accommodates the stroke of marking ram 23. Rotation of marking dail 24 stops when rotation of indexing shaft 36 is stopped, i.e., when detent plate 51 is caused to engage gear 48 by the energization of one of the detent solenoids 53, 54**.

When a desired character or symbol is to be marked onto a workpiece carried on indexing table 22, the desired key is depressed on keyboard 70 and detent plate 51 is shifted into position engaging a predetermined tooth in either row 49 or row 50, depending on which character on marking dial 24 has been selected for imprinting, i.e., depending upon which key on alphanumeric keyboard 70 has been actuated. When each row of teeth on gear 48 contains 20 teeth, the spacing between consecutive teeth of both rows permits double ratchet gear 48 to be stopped in any one of 40 equally-spaced positions. Each such position corresponds to the position of one of 40 characters or symbols provided on marking dial 24. Thus, the stopping of double ratchet gear 48 stops marking dial 24 in a position to mark a character.

Single revolution clutch 30 is actuated when clutch solenoid 33 is energized and retracts, partially rotating cam block 32 to release stop pin 31 on clutch 30. By providing positive engagement of cam block 32 with stop pin 31, successive strokes of marking ram 23, and thus of dial 24, can take place only by reenergization of clutch solenoid 33.

When marking dial 24 descends, the character at the marking location, i.e., the bottom of dial 24 is impressed into the workpiece which is carried on indexing table 22 and supported by anvil 85. Rack 93, which engages escapement pinion 90, links anvil 85 with escapement wheel 87. Negator spring 86 provides a constant pull to move anvil 85 to the left; however, such motion is restrained by escapement cam 88 a detent face of which engages a tooth on escapement wheel 87. The energization of spacing solenoid 35 permits only one tooth of escapement wheel 87 to pass cam 88 at a given time, thereby permitting indexing table 22 to shift one space to the left. Spacing solenoid 35 is energized by limit switch 34 at a predetermined position of cam 25 at the end of each marking cycle. Thus, as soon as an imprint has been made, indexing table 22 is moved to a new position.

When a key is depressed on keyboard 70, the key closes one of the switches 72-1 through 72-40 corresponding thereto. When the circuit including the closed switch is energized, as explained below, either detent solenoid 53 or detent solenoid 54 is energized to pull detent plate 51 from its neutral position into engagement with a tooth in row 49 or row 50 of gear 48. Subsequently, clutch solenoid 33 is energized to release single revolution clutch 30. The energized detent solenoid 53 or 54 is maintained energized so that the marking cycle can be completed even if the initially depressed key is released before completion of the marking cycle.

As clutch 30 turns, slide block 46 is depressed by the movement of eccentric cam 25 to make the imprint and is then returned to an upper rest position. As clutch 30 continues to turn, spacer solenoid 35 is pulsed, thereby moving indexing table 22 one space further to the left as described hereinabove, clutch solenoid 33 is released causing stop pin 31 to abut cam block 32, and the energized detent solenoid is also released. If the keyboard key is still depressed at this time, the control system precludes reenergization of both the detent solenoids 53, 54 and the clutch solenoid 33 until the key is ultimately released. Thereafter the marker is ready to execute the next marking cycle.

Figure 10:
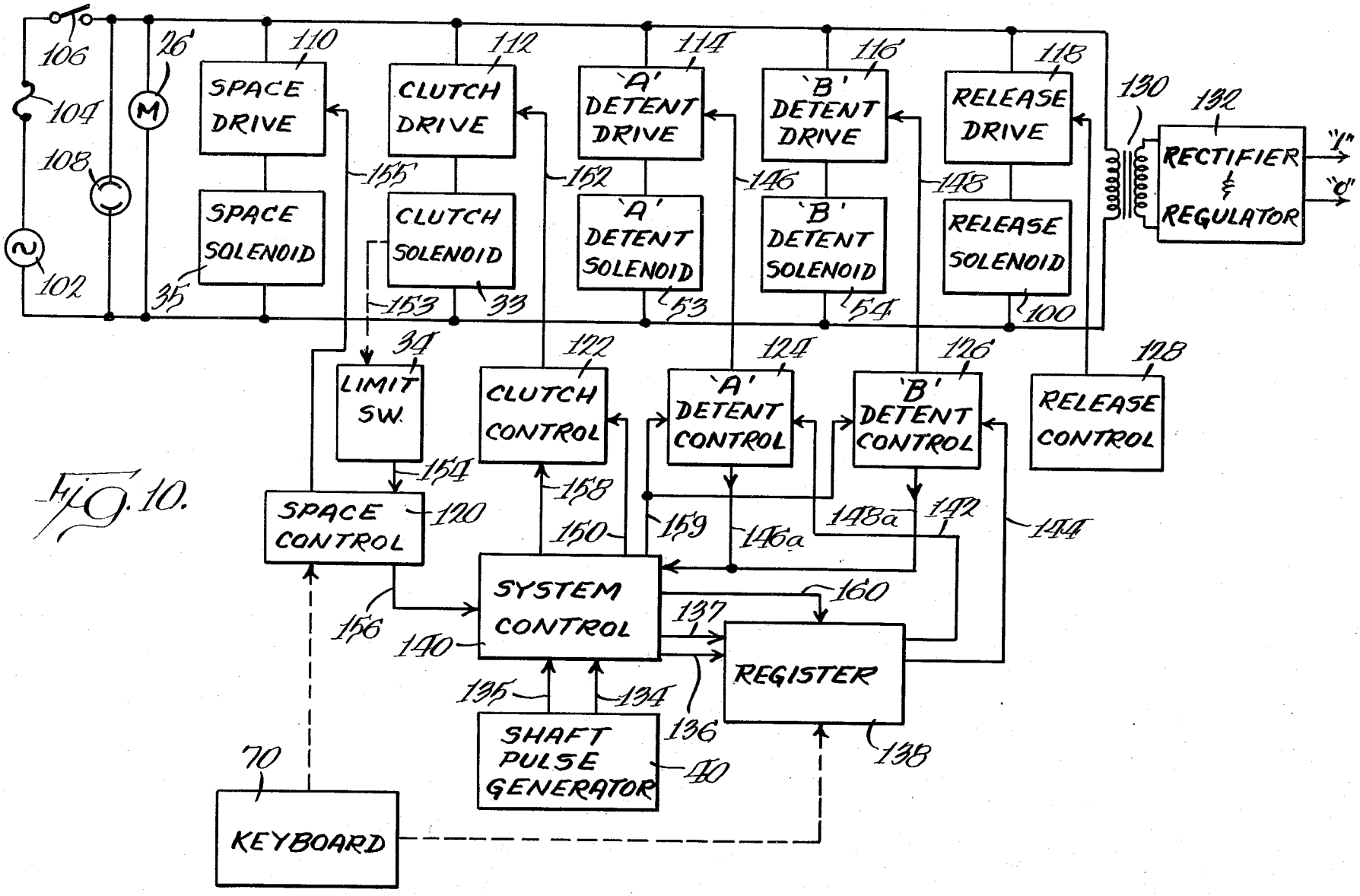
FIG. 10 is a block diagram of a control system incorporating the present invention.

Referring now to FIG. 10, there is shown a block diagram of an electronic control system for governing the operation of the marking machine 20 as described above. The marking machine is connected to a source of ac potential 102, such as the usual 100 volt line outlet, through a fuse 104 and a power switch 106. When the power switch 106 is closed, a pilot light 108 is energized and the motor 26 is energized to operate as described above.

In addition, power is applied to a plurality of solenoid drive circuits each connected in series with a corresponding solenoid, e.g., a spacer drive circuit 110 connected in series with the spacer solenoid 35, a clutch drive circuit 112 connected in series with the clutch solenoid 33, an "A" detent drive circuit 114 connected in series with the "A" detent solenoid 53, a "B" detent drive circuit 116 connected in series with the "B" detent solenoid 54, and a release drive circuit 118 connected in series with the release solenoid 100. The respective drive circuits are typically normally open opto-isolated switching circuits which close in response to a control signal applied thereto for connecting their corresponding solenoids across the power source.

Each of the drive circuits 110, 112, 114, 116, 118 is operated by control signals applied thereto by corresponding control circuits, the space control circuit 120, the clutch control circuit 122, the "A" detent control circuit 124, the "B" detent control circuit 126, and the release control circuit 128, respectively. Each of the control circuits 120, 122, 124, 126 and 128 produces a binary digital output. In the disclosed embodiment, when a control circuit generates a low or "0" output the corresponding drive circuit is energized and the opto-isolated switch is closed to effect energization of the corresponding solenoid. When a control circuit generates a high or "1" output, the corresponding drive circuit is deenergized to open the opto-isolated switch and deenergize the corresponding solenoid.

The source 102 is also connected to the primary of a step down transformer 130 the secondary of which is connected to suitable rectifier and regulating circuitry 132 which provides regulated dc low voltage to the various circuits in the control system as required.

In operation, when the power switch is closed and the motor is energized, the optical shaft position pulse generator 40 begins to produce a plurality of timing pulses on line 134 as the apertures 62 pass through the gap in optical limit switch 66 and periodic reset pulses on line 135 as the reset aperture 64 on the disc 38 passes through the gap of optical limit switch 68.

The timing and reset pulses are applied to a shift register 138 through the system control 140. The register 138 produces a plurality of outputs in response to the timing pulses on line 135 as a function of the rotation of the coded disc 38 being rotated or driven by indexing shaft 36. In the illustrated embodiment, described with respect to FIGS. 11*a* and 11*b* in more detail below, the register produces a series of outputs each one corresponding to one of the characters or symbols on the marking dial 24 as that symbol is in the marking position.

When it is desired to mark or imprint a character, that symbol is selected by depressing or actuating the corresponding key on keyboard 70. The register 138 is responsive to the selected symbol to produce an output either on output line 142 connected to the "A" detent control circuit 124, or on output line 144 connected to the "B" detent control circuit 126. The corresponding detent control circuit 124, 126 produces a control signal on its corresponding output line 146, 148, respectively, connected to the corresponding drive circuit 114, 116 to energize the corresponding detent solenoid 53 or 54 and effect operation of the detent plate 51 to engage appropriate set of gear teeth 49 or 50 of double ratchet gear 48 as described above.

The output 146*a* or 148*a* of the corresponding detent control circuit 124, 126 is also connected to the system control 140 which produces an output 150 to energize clutch control circuit 122. There is a delay in energizing the clutch control circuit 122 is to insure that the marking cycle is not initiated until one of the detent solenoids 53, 54 has bee energized and the marking dial 24 stopped with the selected symbol in marking position. The energized clutch control circuit 122 produces a control signal on line 152 to energize the clutch drive circuit 112 and the clutch solenoid 33.

Simultaneously, the system control 140 effectively disconnects the outputs 134, 135 of the shaft position pulse generator 40 from the register 138 to sustain the selected output of the register and maintain the corresponding detent solenoid energized.

As explained above, after the clutch solenoid 33 is energized to initiate the marking cycle, a limit switch 34 is closed near completion of the marking cycle (as indicated by dotted line 153). Closure of the limit switch 34 effects energization of the space control circuit 120 over line 154 to produce space control signal 155, to energize the space drive circuit 110 and to energize the space solenoid 35. Opening of the limit switch 34, deenergizes the space control circuit 120, the space drive circuit 110 and space solenoid 35 to complete movement of the indexing table 22 and workpiece supported thereon to position the next area of the workpiece in the marking position. The space control circuit 120 can also be energized directly from the keyboard 70 upon depression and release of a space key or space bar.

The space control circuit 120, when energized, also applies a control 156 to the system control 140. The system control 140 is responsive to the space control output 156 to generate signals on lines 158, 159 to deenergize the clutch control circuit 122 and the energized detent control circuit 124 or 126 with the resultant deenergization of the clutch solenoid 33 and the detent solenoid 53 or 54. This allows rotation of the indexing shaft 36 to resume.

In order to preclude inadvertent energization of the detent and clutch control circuits and inadvertent marking of the workpiece, the system control 140 continues to inhibit application of the pulses on lines 134, 135 produced by the shaft position pulse generator 40 to the register 138 until the selected key on the keyboard 70 is released. When the key is released, the system control applies a clear pulse on line 137 to terminate all outputs therefrom and connects the output pulses 134 of the pulse generator 40 to line 136 and to the register 138.

However, because the register 138 has been cleared, it produces no outputs until the reset or clear pulse on line 135 is applied thereto over line 137. As shown, with respect to the description of FIGS. 11*a*, 11*b* and 12, the clear or reset pulse also applies a data pulse on line 160 to the input of the first stage of the register 138 which then responds to the next timing pulse on lines 134, 136 to store that bit in the first stage of the register 138 and produce an output on the first output line of the register 138.

Figure 11A:
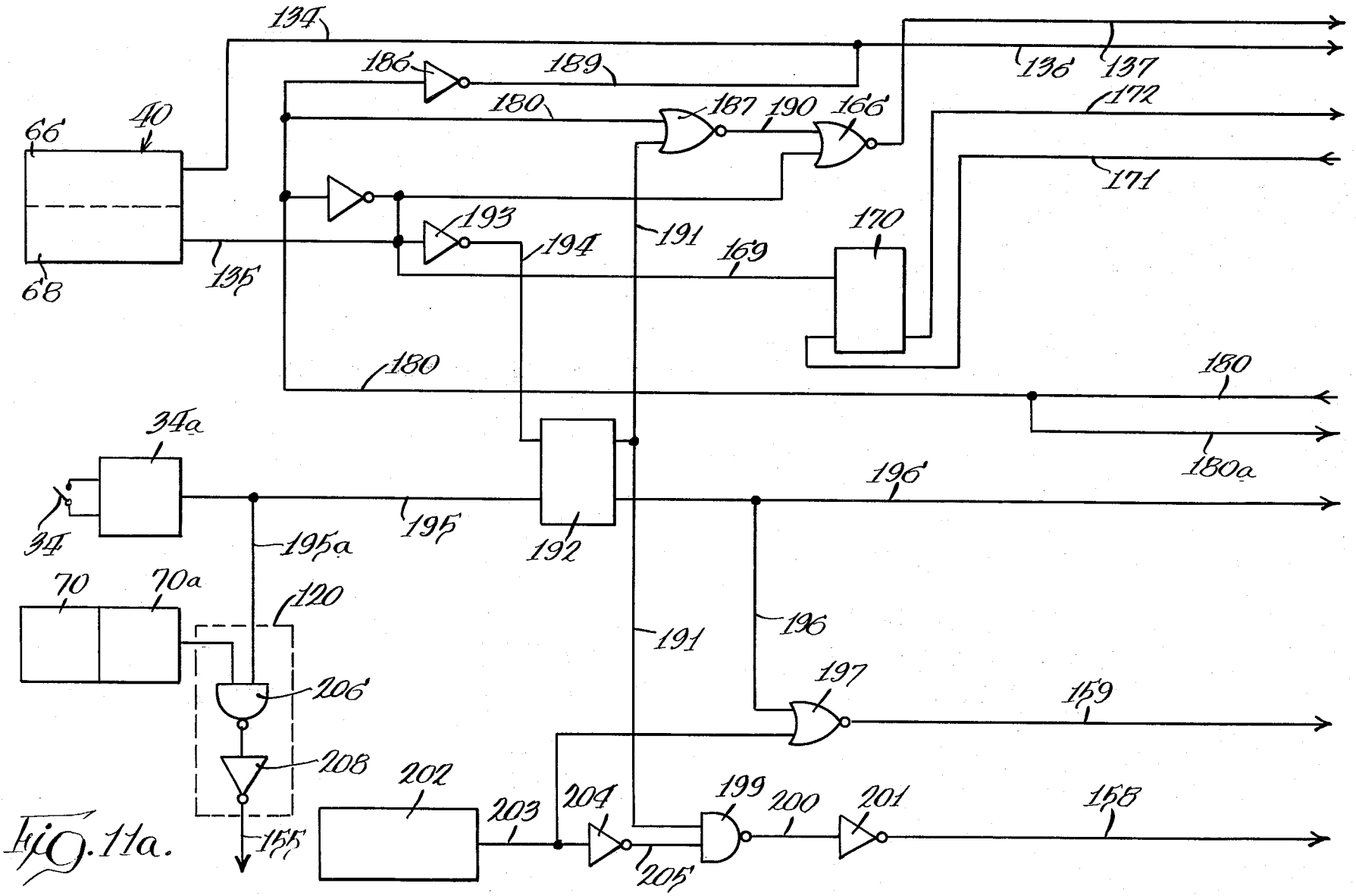
FIGS. 11*a* and 11*b* together is a more detailed diagrammatic logic circuit of the control system.
Figure 11B:
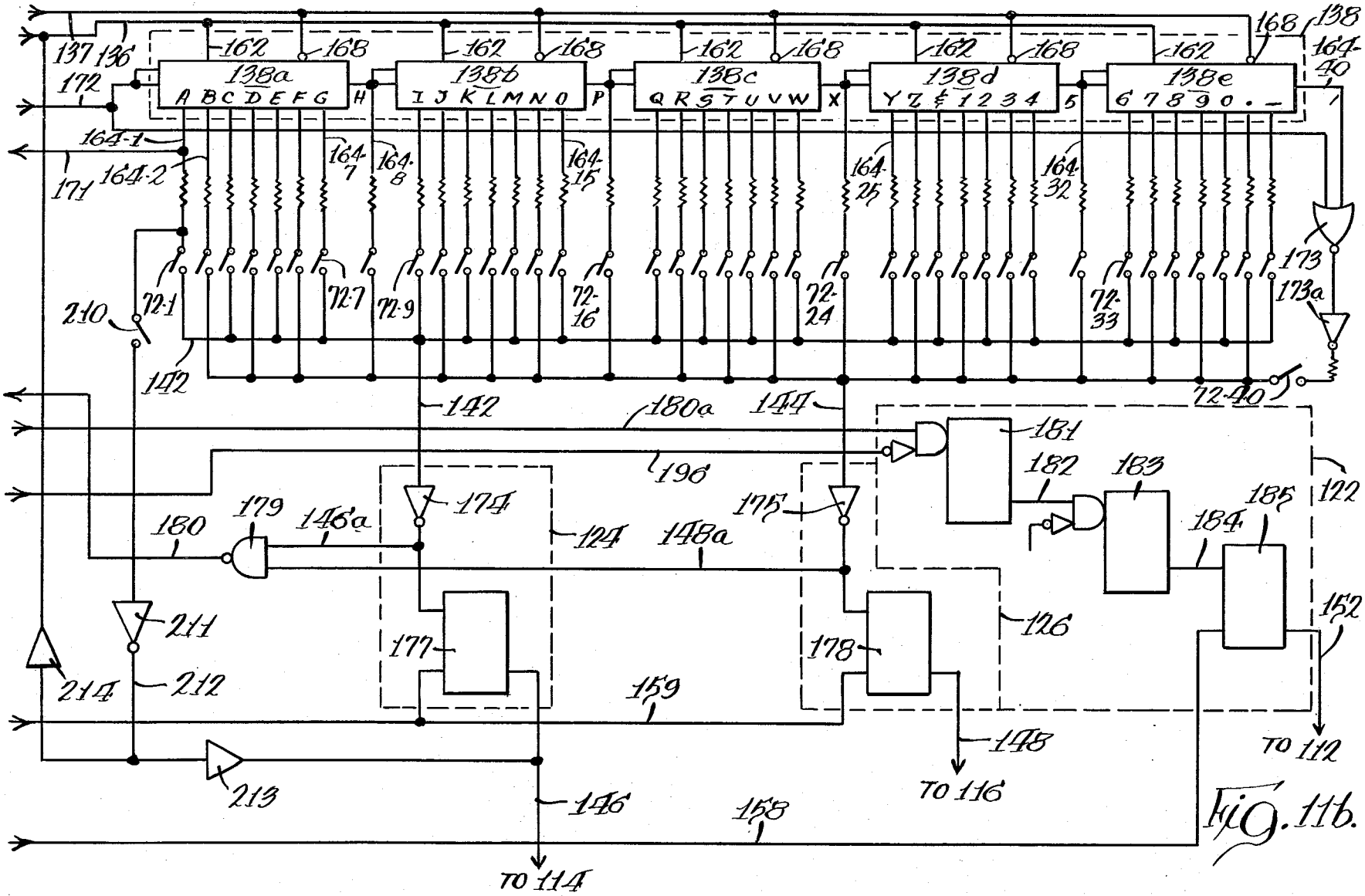
Figure 12:
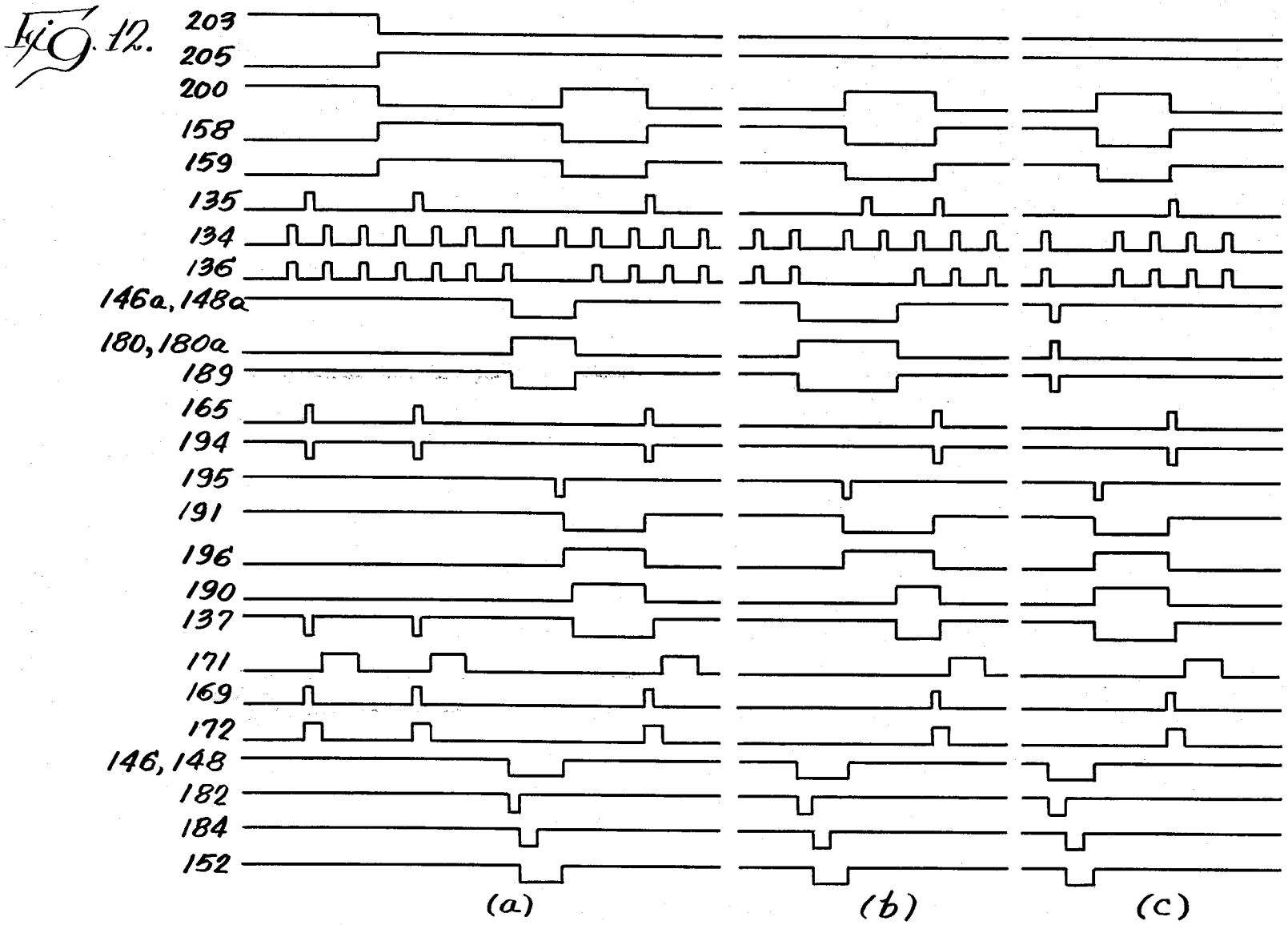
FIG. 12 is a timing diagram helpful in understanding aspects of the control system.

A more complete understanding of the operation of the control system of FIG. 10 can be had by reference to FIGS. 11*a* and 11*b* and to the timing diagram of FIG. 12. As indicated, the optical switches 66, 68 forming part of the shaft position pulse generator 40 produce timing pulses on line 134 and reset pulses on line 135. The timing or clock pulses are normally applied over lines 134, 136 to the shift inputs 162 of the five interconnected sections 138*a*–138*e* of the shift register 138, having a plurality of bistable stages.

As each of the clock pulses is applied to the shift inputs 162, data in each stage of the register is shifted to the right (as shown in FIG. 11*b*) to the next adjacent stage, i.e., each stage assumes the stable state of the adjacent stage to its left. In one stable stage, a "1" is stored in a stage, and a "1" output is produced on the corresponding output line 164-1 through 164-40 connected to that stage. After each plurality of 40 clock pulses has been generated by the pulse generator 40, a clear pulse is generated on line 135.

The clear pulse is applied over lines 135, 165 to one input of a first clear control NOR gate 166 causing the output 137 of the NOR gate 166 to go to "0". The "0" output of NOR gate 166 is the clear signal which is applied to the inverting clear inputs 168 of each of the sections of the register 138, to clear each stage of the register, i.e., cause each stage to go to "0". Simultaneously, the "1" clear pulse on line 135 is applied over line 169 to the first input of a NOR reset latch 170 which receives its second input 171 from the first output line 164-1 of register 138. Since the register 138 is cleared by the clear pulse applied to reset inputs 168, the output on the line 164-1 is "0". The resulting output 172 of the NOR reset latch 170 is "1", which is applied to the input of the first stage of the shift register 138.

When the first clock pulse after the clear or reset pulse is applied to the register over lines 134, 136, the "1" at the input is shifted into the first stage of register 138 to produce a "1" on the first output line 164-1. The output 164-1 is applied over line 171 to the second input of the NOR reset latch 166 to switch its output 172 to "0" so that the next clock pulse does not shift any data into the first stage of register 138.

Thus, as each clock pulse is applied to the register 138, the "1" in the first stage is shifted successively through the next 39 stages until upon receipt of the 40th clock pulse after the preceding clear or reset pulse, a "1" output appears on output line 164-40 and is applied to one input of the 40th stage NOR gate 173. The output of NOR gate 173 is connected to the input of the 40th stage or supplemental inverter 173*a*. The other input to the 40th stage or supplemental NOR gate 173 is connected to the output 172 of the reset NOR latch 170 to sustain the 40th stage output after the register 138 is reset. This minimizes the criticality of the positioning of the reset aperture 64 relative to the coded apertures 62 and the corresponding relative placement of the optical limit switches 66, 68.

Thus, as the aperture disc 38 is rotated, a pulse or "1" is applied on line 172 to the input of the shift register 138 and is successively shifted through the register's 40 stages until the reset or clear pulse is applied to the register on line 137 to clear all the stages of the register and to sustain the 40th output on line 164-40. The first clock pulse after the reset pulse initiates repetition of this cycle, terminates the "1" output 172 from the reset latch 170 thereby terminating both the input to the first stage and the output from the 40th stage.

Each of the 39 output lines from the register and the 40th output line from the inverter incorporates one of the keyboard switches 72-1 through 72-40 each of which is connected to one of the keys of the keyboard 70. The key to which each line is connected is determined by the arrangement of the characters or symbols on the marking dial 24. In one illustrated embodiment, the dial includes the letters of the alphabet, followed by an "&", followed by the ten numerical characters, followed by a ".", a "-" and "/" as shown in FIG. 11*b*. This is the same order in which the characters appear on the marking dial 24. The marking dial is positioned on the machine so that the letter "A" is in the marking position when the first clock or timing pulse after a reset or clear pulse is applied to the register.

As seen in FIG. 11*b*, alternate ones of output lines 164 are connected to one register output line 142 and the balance are connected to register output line 144. The first output line 142 is designated the "A" line since the "A" output line 164-1 is connected thereto, and the second output line 144 is designated the "B" line because the output line 164-2 corresponding to the character or symbol "B" is connected thereto. "A" output line 142 is connected to the input of an inverter 174 forming part of the "A" detent control circuit 124, and "B" output line 144 is connected to the input of an inverter 175 forming part of the "B" detent control circuit 126.

When no characters have been selected, i.e., when all of the switches 72 are open, the "A" and "B" outputs 142, 144, the inputs to both the "A" and "B" inverters 174, 175, are "0", and the outputs **146*a*, 148*a* of the inverters 174, 175, therefore are "1". The output 146*a* of the inverter 174 is applied to the control input of a NAND latch 177, the "A" control latch, and the output 148*a* of the inverter 175 is applied to the control input of a "B" control NAND latch 178. Since the outputs 146*a*, 146*b*, of the inverters 174, 175 are "0" when no characters are selected, the signals on lines 146, 148 are each "1" to preclude energization of the detent drive circuits 114, 116. Both outputs 146*a*, 148*a* of the detent control inverters 174, 175 are also connected to the inputs of a system control NAND gate 179 which responds to "1's" on both inputs to produce a 370" output 180**.

The output 180 of the system control NAND gate is connected over line 150 to the input of a one shot trigger circuit 181 which forms part of the clutch control circuit 122. The output 182 of the first one shot trigger circuit 181 is connected to the input of a second one shot trigger circuit 183. The output 184 of the second one shot trigger circuit is applied to the control input of a clutch control NAND latch circuit 185 the output 152 of which is applied to the control input of the clutch drive circuit 112, as described above.

The output 180 of the system control NAND gate 179 is also applied to the input of a system clock control inverter 186, to one input of a second clear control NOR gate 187 and to the input of a first system clear control inverter 188. When the output 180 of the system control NAND gate 179 is "0", i.e., when no characters have been selected, the output 189 of the control inverter 186 is "1". Since, in the illustrated embodiment a "0" overrides a "1", the "1" output 189, which is connected to the clock output line 136, allows the clock or timing pulses on line 134, generated by the shaft position pulse generator 40, to be applied to the shift inputs 162 of the register 138. When the output 189 of the clock control inverter 186 goes to "0", as explained below, application of the clock pulses is inhibited since the "0" output on line 189 overrides the "1" clock pulses on line 134.

When the output 180 is "0", the output 190 of the clear control NOR gate 187 is the inverse of the other input, the output 191 of a system control NAND latch 192. Initially, as explained below, the output 191 of latch 192 is "1" and, therefore, the output 190 of NOR gate 187 is "0". The output 190 is connected to the second input of the system clear control NOR gate 166, the other input 165 of which is connected to the output of system control inverter 188 and to the reset output 135 of the shaft position pulse generator 40.

Since the output of inverter 188 is "1" when the output 180 of system control NAND gate 179 is "0", i.e., when no character has been selected, the signal on line 165 is the same as the signal on line 135. This is "0", except when a reset pulse is produced by the pulse generator 40, and since the signal on line 190 is also "0" at this point in time, the output 137 or NOR gate 166 is "1".

When a reset pulse is produced on line 135, the signal on line 165 goes to "1" and the output 137 of NOR gate 166 goes to "0". This pulse is applied to the inverting clear inputs 168 of the register 138 to clear the register as described above.

The reset pulse on line 135 is also applied to the input of a second system control inverter 193, the output 194 of which is applied to the first input of the system control NAND latch 192. The other input 195 to the system control NAND latch 192 is connected to the output of the space limit switch circuit **34*a* and is normally "1". When a reset pulse is generated on line 135, the output 194 of inverter 193 goes to "0" which in conjunction with the "1" normally present on line 195 produces a "1" on line 191 and a "0" on the second output line 196 of the system latch 192**.

The second output 196 is applied to the inhibit input of the one shot trigger circuit 181. Whhen the output 196 of latch 192 goes to "1", the one shot trigger circuit 181 is inhibited to preclude energization thereof even if a trigger pulse is applied to its other input 150. As a result, the clutch solenoid 33 cannot be energized inadvertently. The normally present "0" on line 196 enables the one shot 181 so that it is capable of responding to a "1" on line 150 when a character or symbol is selected, as will be described below.

The output 196 of the system control latch 192 is also applied to one input of a detent clear NOR gate 197 the output 159 of which is connected to the inhibit inputs of both the "A" control NAND latch 177 and the "B" control NAND latch 178. When the output 159 goes to "0", both of the detent NAND latches 177, 178 are reset to produce "1's" on the respective output lines 146, 148 to insure that the corresponding detent solenoids 53, 54 are deenergized.

The output 191 of system control latch 192 is also applied to one input of a clutch clear NAND gate 199. The output 200 of NAND gate 199 is applied to an inverter 201, the output 158 of which is applied to the inhibit input of the clutch control latch 185. When the output 158 of inverter 201 goes to "0", the clutch control latch 185 is reset to produce a "1" on output line 152 to insure the clutch solenoid is deenergized.

When one of the switches 72-1 through 72-40 is closed, in response to actuation of a corresponding key of keyboard 70, the corresponding output circuit 142 or 144 of the register 138 is enabled. As the clock pulses are applied to the shift inputs 162 of register 138, the "1" bit is shifted through the register until it is shifted into that stage which corresponds to the selected character, i.e., the stage connected to the output line 164 including the closed switch 72.

The system also includes an automatic reset operable when the power is first turned on. The power on reset circuit 202 produces a "1" signal on line 203 for a predetermined time period after the power switch 106 is first closed. The "1" on line 203 is applied to the second input of the detent clear NOR gate 197 thereby causing the output 159 of gate 197 to go to "0" to reset and inhibit the "A" control NAND latch 177 and the "B" control NAND latch 178, as described above. The "1" output 203 is also applied to an inverter 204. The resulting "0" output 205 of the inverter 204 is applied to the second input of NAND gate 199. The resulting "1" output 200 of the NAND gate 199 is applied to inverter 201 to produce a "0" output 158 to clear and inhibit the clutch control latch 185 as described above.

The output 203 of the power on reset circuit 202 remains at "1" for a period sufficient to insure that at least one reset pulse is produced on line 135 by the optical limit switch 68 to clear the register 138 and reset the control circuit. After this predetermined time period, the output 203 of the power on reset circuit 202 goes to "0". As a result the outputs 158 and 159 go to "1" to enable the corresponding latch circuits 177, 178, 185, as described above.

For purposes of illustration, it will be assumed that the character or symbol selected to be marked is the letter "C". Initially, the power is turned on by closure of the power switch 106 causing the output 203 of power on reset circuit 202, to go high, the output 205 of inverter 204 to go low, the output 200 of NAND gate 199 to go high and the output 158 of inverter 201 and the output 159 of NOR gate 197 to thereby go low, resetting and inhibiting the clutch latch 185 and the "A" and "B" control latches 177, 178.

Since the motor 26 is energized when the power switch 106 is closed, the indexing shaft 36 is rotated to drive the code wheel 38 and produce timing pulses on line 134 and reset pulses on line 135. Until such time as the output on line 203 goes to "0", operation of any of the keys on switchboard 70 to close one of the switches 72 will have no effect because the "0" inhibit signals on lines 158 and 159 preclude operation of the latch circuits 177, 178, 185 to produce energizing "0" outputs on lines 146, 148, 152, respectively. The timing and reset pulses produced on lines 134, 135, respectively, are applied to the register 138 over lines 136 and 137. The signal on line 203 goes to "0" after at least one reset pulse has been produced on lines 135 and 137 to reset the register 138.

In order to select the letter "C", the corresponding key on keyboard 70 is depressed to close switch 72-3 connected between output line 164-3 and the "A" output line 142. Upon occurence of the third clock pulse after a clear pulse, the "1" bit is shifted into the third stage of register 138. Since switch 72-3 is closed, a "1" output is applied over line 164-3 and "A" output line 142 to the input of the "A" inverter 174. The output 146*a* of the "A" inverter 174 is driven to "0". This "0" output is applied to the control input of the "A" NAND latch 177 to produce a "0" control signal on line 146.

As described above, the "0" signal on line 146 is applied to the control input of the "A" detent drive circuit 114. This effects energization of the "A" detent solenoid 53 to shift the detent plate into engagement with one of the gear teeth 49 of the double ratchet gear 48 to stop the marking dial 24 with the character or symbol "C" in the lowermost or marking position.

Simultaneously, the "0" on line 146*a* is applied to the system control NAND gate 179 to produce a "1" on lines 150, 180 since the other input 148*a* to NAND gate 179 is "1". The "1" on line 150 is applied to the trigger input of the first one shot trigger circuit 181 to produce a negative going pulse on line 182. When the pulse on line 182 returns to its high level, it triggers the second one shot trigger circuit 183 which produces a negative output pulse on line 184. The negative pulse on line 184 is applied to the control input of the clutch control latch 185 to produce a "0" output on line 152 which is applied, as described above, to the control input of the clutch drive circuit 112 to energize the clutch solenoid 33 and effect displacement of the marking dial 24 to mark the letter "C" on a workpiece supported on indexing table 22.

In order to preclude the application of additional timing pulses to the register and to insure proper energization of the selected detent and clutch solenoids, the "1" on line 180 is also applied to the inverter 186 to produce a "0" on line 189. Since, as described above, the "0" on 180 overrides any timing pulses on line 134, the signal on line 136 is maintained at "0" to preclude application of any timing pulses to the shift inputs 162 of register 138.

Simultaneously, the "1" on line 180 is applied to one input of the second clear control NOR gate 187 to insure that the output 190 thereof, connected to the input of first clear control NOR gate 166, remains at "0". the "1" output 180 of NAND gate 179 is also applied to the input of inverter 188 to produce a "0" output 165 which is applied to the second input of NOR gate 166. Since both inputs 165, 190 to NOR gate 166 are "0", the output 137 is maintained at "1" to preclude clearing of the register 138, thereby maintaining the bit of information in the third or "C" stage for the duration of the marking cycle.

When the clutch solenoid 33 is energized, the marking cycle is initiated and the marking dial 24 is displaced. As the marking dial 24 is retracted, the limit switch 34 is momentarily closed and then reopened. When the limit switch 34 closes, the limit switch circuit 34*a* produces a negative or "0" pulse on line 195 which has two effects. The "0" on line 195*a* applied to one input of the spacer control NAND gate 206 produces a "1" output 207, applied to spacer control inverter 208 to produce the "0" output on line 155 to energize the spacer drive circuit 110 nd the spacer solenoid 35. Simultaneously, the "0" on line 195 is applied to the system control NAND latch 192 to produce a "0" output on line 191 and a "1" output on line 196.

The "0" on line 191 is applied to one input of the second clear control NOR gate 187. Although there is no immediate effect on the output 190 which remains at "0", because the other input 180 is "1", NOR gate 187 is thereby enabled to respond to the release of the keyboard key to produce a reset pulse as will be explained below. The "0" on line 191 is also applied to the clutch clear NAND gate 199 to produce a "0" output 158 to reset and inhibit clutch latch 185. The clutch solenoid 33 is thereby deenergized.

Simultaneously, the "1" output 196 is applied to the inhibit input of the first one shot trigger circuit 181 to preclude generation of any negative pulses on line 182 to insure that the clutch control circuit 122 can not be energized. The "1" output 196 is also applied to detent clear NOR gate 197 to produce a "0" output on line 159 to reset the energized "A" detent control latch 177, thereby deenergizing the "A" detent solenoid 52 to allow the marking dial 24 to resume rotation.

As seen in FIG. 12, even though the dial and the code disc 38 begin to rotate, thereby producing timing pulses on line 134, the "0" output 189 of clock control inverter 186 inhibits the application of the shift pulses to the shift inputs 162 of register 138.

When spacer limit switch 34 opens, the outputs 195, 195*a* of limit switch circuit 34*a* goes to "1". As a result, the output 155 of space control circuit 120 goes to "1" to deenergize spacer solenoid 35 to complete the spacing of the workpiece as described above. The "1" input 195 to system control NAND latch 192 has no effect since the other input 194 is also "1".

When the selected "C" key of keyboard 70 is released, switch 72-3, in line 164-3, is opened. The output 142 goes to "0", and the output 146a goes to "1". When output 146a goes to "1" the output 180 of NAND gate 179 returns to "0". This results in the output 189 of inverter 186 going to "1" to effectively couple the timing pulses on line 134 to the register shift inputs 162 over line 136.

Since both inputs to NOR gate 187 are now "0", the resulting "1" output 190 of NOR gate 187, applied to NOR gate 166 produces a "0" reset signal on line 137 to clear the register 138. This precludes inadvertent and erroneous initiation of a marking cycle prior to the time a reset pulse is produced on line 135 to synchronize the system.

When a reset pulse 135 is produced, it is applied over line 165 to the second input of NAND gate 166. Since at this time the output 190 of the NOR gate 187 is still "1", the reset output 137 remains at "0". The reset pulse 135 is also applied to an inverter 193, the "0" output 194 of which is applied to the system control latch 192 to reverse outputs 191, 196, output 191 going high to "1", output 196 going low to "0".

The "1" output 191 of latch 192 switches the output 190 or NOR gate 187 to "0" and terminates the "0" clutch latch clear signal 158. The "0" output 196 of latch 192 terminates the detent clear signal 159 to inhibit input input to the trigger circuit 181.

The clear pulse 135 is also applied to input 169 of reset latch 170 to produce a "1" output 172 applied to the input of the first stage of register 138. As described above, when the next clock pulse is applied to the shift inputs 162 of the register 138, the "1" output 172 of latch 170 is shifted into the first or "A" stage. The resulting output on line 164-1 is applied to the reset input 171 of latch 170 to terminate the "1" output 172.

The cycle of operation is now repeated and upon depression of the next key for selection of a character or symbol to be marked the marking cycle is once again initiated, as described above.

The timing diagram, FIG. 12, has been divided into three portions, section (a), which reflects an operating cycle in which a key is depressed, the space control limit switch 34 is closed, the keyboard key is released and a reset pulse is produced thereafter. Section (b) of the timing diagram illustrates that the same effect occurs when the operating cycle includes the steps of depressing the key, closure of the space limit switch, producing a reset pulse, releasing the key on keyboard 70 followed by an additional reset pulse to enable the system. Finally, FIG. 12(c) shows that the same results occur even when the key is released before the space limit switch is closed. Thus in all cases, the system is disabled until a reset pulse is produced after both the key is released and the spacer limit switch is closed momentarily.

When it is desired to change the marking dial, the system may be conveniently operated to stop the index shaft 36 and the marking dial 24 in a preselected position. A manual switch 210 connected to the "A" output line 164-1 is closed. The switch 210 connects the "1" output when the bit is in the first stage of register 178 to the input of an inverter 211. The resulting "0" output 212 of inverter 211 is connected through an amplifier 213 to the "A" detent drive circuit 114 to energize the "A" detent solenoid when, in the illustrated example, the character or symbol "A" as in the marking position. Simultaneously, the "0" output 212 is connected through an amplifier 214 to line 136 to inhibit the application of shift pulses to the shift inputs 162, since as explained above, the existence of a "0" on line 212 overrides any pulses on line 136. When the set up for replacement of the dial is completed, the switch 210 is open and the normal system operation is resumed.

For clarity, the details of the release control circuit 128 (FIG. 10) has been omitted from FIGS. 11a and 11b. The release control is effectively a manual switch and associated circuitry which when closed produces a "0" output to the release drive circuit 118 to effectively energize the release solenoid 100 in a manner similar to that described with respect to the other drive and solenoid circuits.

Thus, there has been disclosed a control system particularly adaptable for apparatus of the type utilized for imprinting or marking workpieces which provides rapid, reliable and accurate control of the apparatus operation, which allows for maximizing the operating speed of the mechanical components since the system of the present invention provides a speed capability far in excess of the capabilities of the mechanical components.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. An electronic control system for a marking machine of the type having:

a marking member carrying a plurality of marking symbols, means for driving said marking member to sequentially move said symbols past a marking location, manually actuatable and deactuatable means for selecting one of said symbols, and means for momentarily displacing said marking member into engagement with a workpiece to effect marking thereof with said selected one of said symbols at said marking location;

said control system comprising:

means for generating a plurality of pulses in response to movement of said marking member and in synchronism with the movement of said symbols past said marking location;

means responsive to said plurality of pulses for producing a plurality of outputs corresponding to said symbols;

means responsive to actuation of said symbol selecting means for selecting one of said outputs corresponding to said selected symbol;

means responsive to said selected output for effecting energization of said marking member displacing means to effect said momentary displacement of said marking member;

means responsive to said selected output for precluding selection of another of said plurality of outputs until the workpiece is marked;

means responsive to said momentary displacement of said marking member for effecting deenergization of said marking member displacing means after the workpiece is marked;

means responsive to said momentary displacement of said marking member for temporarily inhibiting reenergization of said marking member displacing means to preclude inadvertent marking of the workpiece; and means responsive to said momentary displacement of said marking member and to deactuation of said symbol selecting means for terminating said plurality of outputs while reenergization of said marking member displacing means is temporarily inhibited to further preclude inadvertent marking of the workpiece;

whereby the workpiece is marked by the selected one of said symbols located at said marking location.

2. An electronic control system for a marking machine of the type having:

a marking member carrying a plurality of marking symbols, means for driving said marking member to sequentially move said symbols past a marking location, manually actuatable and deactuatable means for selecting one of said symbols, means for momentarily displacing said marking member into engagement with a workpiece to effect marking thereof with said selected one of said symbols at said marking location;

spacer means for advancing the workpiece to position successive portions thereof at said marking location; and means operated in response to said momentary displacement of said marking member after the workpiece is marked;

said control system comprising:

means for generating a plurality of pulses in response to movement of said marking member and in synchronism with the movement of said symbols past said marking location;

means responsive to said plurality of pulses for producing a plurality of outputs corresponding to said symbols;

means responsive to actuation of said symbol selecting means for selecting one of said outputs corresponding to said selected symbol;

means responsive to said selected output for effecting energization of said marking member displacing means to effect said momentary displacement of said marking member;

means responsive to operation of said displacment responsive means for energizing said spacer means;

means responsive to said spacer energizing means for temporarily inhibiting energization of said marking member displacing means to preclude inadvertent marking of the workpiece; and means responsive to said spacer energizing means and to the actuation of said symbol selecting means for terminating said plurality of outputs to further preclude inadvertent marking of the workpiece;

whereby the workpiece is marked by the selected one of said symbols located at said marking location.

3. An electronic control system for a marking machine of the type having:

a marking member carrying a plurality of marking symbols, means for driving said marking member to sequentially move said symbols past a marking location, manually actuatable and deactuatable means for selecting one of said symbols, and means for momentarily displacing said marking member into engagement with a workpiece to effect marking thereof with said selected one of said symbols at said marking location;

said control system comprising:

means for generating a plurality of pulses in response to movement of said marking member and in synchronism with the movement of said symbols past said marking location;

means responsive to said plurality of pulses for producing a plurality of outputs corresponding to said symbols;

means responsive to actuation of said symbol selecting means for selecting one of said outputs corresponding to said selected symbol;

means responsive to said selected output for effecting energization of said marking member displacing means to effect said momentary displacement of said marking member;

means for generating a reset pulse after a selected number of said plurality of pulses;

said output producing means being responsive to said reset pulse for terminating said plurality of outputs;

means responsive to said reset pulse for applying an input to said output producing means; and said output producing means being responsive to one of said plurality of pulses and to said input for producing a first of said plurality of outputs;

whereby the workpiece is marked by the selected one of said symbols located at said marking location.

4. A control system as claimed in claim 3 including:

means responsive to said first output for terminating said input to said output producing means.

5. A control system as claimed in claim 4 wherein:

said output producing means produces a different one of said plurality of outputs in response to each of said plurality of pulses.

6. A control system as claimed in claim 4 including:

supplemental means responsive to one of said plurality of outputs for producing at least one supplemental output corresponding to a preselected one of said symbols;

said output selecting means being responsive to actuation of said symbol selecting means to select said preselected one of said symbols for selecting said supplemental output.

7. A control system as claimed in claim 6 wherein:

said supplemental means is further responsive to said reset pulse for sustaining said supplemental output for the duration of said reset pulse.

8. An electronic control system for a marking machine of the type having:

a marking member carrying a plurality of marking symbols, means for driving said marking member to sequentially move said symbols past a marking location, manually actuatable and deactuatable means for selecting one of said symbols, and means for momentarily displacing said marking member into engagement with a workpiece to effect marking thereof with said selected one of said symbols at said marking location;

said control system comprising:

means for generating a plurality of pulses in response to movement of said marking member and in synchronism with the movement of said symbols past said marking location;

means responsive to said plurality of pulses for producing a plurality of outputs corresponding to said symbols;

means responsive to actuation of said symbol selecting means for selecting one of said outputs corresponding to said selected symbol;

means responsive to said selected output for effecting energization of said marking member displacing means to effect said momentary displacement of said marking member;

said pulse generating means generating said plurality of pulses as a sequential pulse train of individual encoded pulses; and said pulse responsive means being responsive to each individual pulse of said pulse train for sequentially producing a different one of said outputs, each of which corresponds to that one of the symbols located at the marking location;

whereby the workpiece is marked by the selected one of said symbols located at said marking location.

9. A control system as claimed in claim 8 wherein:

said manually actuatable symbol selecting means includes a plurality of manually actuatable members each operable when actuated for selecting one of said symbols; and said means responsive to actuation of said symbol selecting means includes a plurality of switch means each connected to one of said outputs;

each of said switch means being closed in response to actuation of a corresponding one of said manually actuatable symbol selecting members for coupling said one of said plurality of outputs connected thereto to said output responsive means, whereby the output connected to said closed switch means is selected.

10. A control system as claimed in claim 9 wherein:

the marking machine includes means for selectively stopping said marking member; and said control system including:

additional means responsive to said selected output for effecting energization of said marking member stopping means to stop said marking member with the selected one of said symbols at said marking location.

11. A control system as claimed in claim 10 including:

means responsive to said manually actuatable symbol selecting means for coupling one of said outputs to said additional output responsive means; whereby said one output is selected;

said additional output responsive means including means responsive to said selected output for producing a stop control signal; and means responsive to said stop control signal for effecting energization of said marking member stopping means.

12. A control system as claimed in claim 11 wherein:

said output responsive means includes delay means responsive to said stop control signal for producing a displacement control signal after energization of said marking member stopping means; and means responsive to said displacement control signal for effecting energization of said marking member displacing means;

whereby said marking member is first stopped with a selected symbol in the marking position and thereafter is displaced to mark the workpiece with the selected symbol.

13. A control system as claimed in claim 12 including:

means responsive to said stop control signal for producing a system control signal; and means responsive to said system control signal for inhibiting the application of additional pulses of said pulse train to said output producing means;

whereby said selected output is maintained.

14. A control system as claimed in claim 13 wherein:

the marking machine has spacer means for advancing the workpiece to position successive portions thereof at said marking location; and means operated in response to said momentary displacement of said marking member after the workpiece is marked;

said control system including:

means responsive to operation of said displacement responsive means for momentarily energizing said spacer means;

means responsive to said spacer energizing means for terminating said stop control signal and said displacement control signal to effect deenergization of said marking member stopping means and said marking member displacement means and for temporarily inhibiting reenergization thereof;

whereby inadvertent marking of one workpiece is precluded.

15. A control system as claimed in claim 14 including:

means responsive to said spacer operating means and to deactuation of said symbol selecting means for terminating said selected output while energization of said marking member stopping means and marking member displacing means is temporarily inhibited.

16. A control system as claimed in claim 15 including:

means for generating a reset pulse at the end of said sequential pulse train;

means responsive to said reset pulse when said symbol selecting means is deactuated for enabling said output responsive means and said additional output responsive means;

whereby the workpiece can be marked with another symbol.

17. A control system as claimed in claim 16 including means responsive to said reset pulse in the absence of a selected symbol for applying said reset pulse to said output producing means terminating all of said outputs.

18. A control system as claimed in claim 17 including:

means responsive to said reset pulse for applying an input to said output producing means;

said output producing means being responsive to said input and to the first pulse of said pulse train for producing a first of said plurality of outputs.

19. A control system as claimed in claim 18 including:

means responsive to said first output for terminating said input to said output producing means; and said output producing means being responsive to successive pulses of said pulse train for sequentially producing different ones of said outputs.

* * * * *